US007210607B2

(12) United States Patent
Niblett et al.

(10) Patent No.: US 7,210,607 B2
(45) Date of Patent: May 1, 2007

(54) ANTI-SLIP SHINGLE GRIP FOR FASTENING TOOL

(75) Inventors: James R. Niblett, Columbia, MD (US); Todd A Hagan, Windsor, PA (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 11/205,916

(22) Filed: Aug. 17, 2005

(65) Prior Publication Data

US 2006/0059816 A1 Mar. 23, 2006

Related U.S. Application Data

(62) Division of application No. 10/852,979, filed on May 25, 2004, now Pat. No. 6,948,647.

(51) Int. Cl.
*B25C 1/04* (2006.01)

(52) U.S. Cl. ..... 227/130; 227/156; D8/68

(58) Field of Classification Search ..... 227/119, 227/120, 130, 136, 156; D8/68
See application file for complete search history.

(56) References Cited

U.S. PATENT DOCUMENTS

| | | | | |
|---|---|---|---|---|
| 2,207,269 | A | 7/1940 | Schiff | |
| 3,125,761 | A | 3/1964 | Adams | |
| 3,858,780 | A | 1/1975 | Perkins et al. | |
| 4,401,251 | A | 8/1983 | Nikolich | |
| 4,523,646 | A | 6/1985 | Doyle et al. | |
| 4,981,247 | A | 1/1991 | Noll | |
| 5,025,970 | A | 6/1991 | Anderson et al. | |
| D338,819 | S | 8/1993 | Ohkochi | |
| 5,261,588 | A | 11/1993 | Lin | |
| 5,267,682 | A | 12/1993 | Okouchi | |
| 5,628,445 | A | 5/1997 | Braddock et al. | |
| D379,912 | S | 6/1997 | Burke et al. | |
| 5,683,024 | A | 11/1997 | Eminger et al. | |
| 5,709,332 | A | 1/1998 | Coop | |
| 5,862,970 | A | 1/1999 | Cougar | |
| D477,514 | S | 7/2003 | Chen | |
| D501,383 | S | 2/2005 | Fang et al. | |
| 6,948,647 | B1 * | 9/2005 | Niblett et al. | 227/130 |
| D518,698 | S * | 4/2006 | Thomas et al. | D8/69 |
| D520,321 | S * | 5/2006 | Hattori et al. | D8/69 |

FOREIGN PATENT DOCUMENTS

| | | |
|---|---|---|
| DE | P 28 10 069.8 | 9/1978 |
| DE | G 88 00 465.1 | 5/1988 |
| DE | 92 07 390 | 12/1992 |
| DE | 42 33 239 C2 | 1/1998 |
| DE | 199 08 300 C1 | 11/2000 |
| DE | 100 58 034 A1 | 6/2002 |
| EP | 0 131 890 | 5/1988 |

(Continued)

*Primary Examiner*—Scott A. Smith
(74) *Attorney, Agent, or Firm*—Harness, Dickey & Pierce, P.L.C.

(57) ABSTRACT

A fastening tool with a housing assembly, a magazine assembly and a deflectable finger. The housing assembly includes a nosepiece. The magazine assembly, which is coupled to the housing assembly, is configured hold a plurality of fasteners and sequentially feed the fasteners into the nosepiece. The deflectable finger is coupled to the housing assembly and extends outwardly there from.

5 Claims, 15 Drawing Sheets

FOREIGN PATENT DOCUMENTS

| | | |
|---|---|---|
| EP | 0 539 138 B1 | 10/1992 |
| EP | 0 711 219 B1 | 5/1995 |
| EP | 1 188 522 A2 | 3/2002 |
| GB | 1 229 260 | 4/1971 |
| WO | WO 01/34351 A1 | 5/2001 |
| WO | WO 02/45910 A2 | 6/2002 |

* cited by examiner

ANTI-SLIP SHINGLE GRIP FOR FASTENING TOOL

CROSS REFERENCE TO RELATED APPLICATION

This present application is a divisional of U.S. application Ser. No. 10/852,979, filed May 25, 2004 now U.S. Pat. No. 6,948,647.

INTRODUCTION

The present invention generally relates fastening tools and more particularly to a replaceable slip-resistant assembly for a fastening tool.

In some work environments, such as on steeply inclined surfaces that may be routinely encountered by roofers and other construction workers, it may be desirable that a fastening tool, such as a nailer or stapler, have slip-resistant characteristics that would tend to inhibit the tool from moving when the fastening tool is not held by an operator or secured to the operator by a belt loop or other means. To provide an improved level of slip-resistance, some fastening tools have been provided with steel skid plates that are removably attached to the housing of the fastening tool. The steel skid plate may be used by itself or with a solid rubber block, which may be coupled to the steel skid plate, to increase the slip-resistance of the steel skid plate. Other fastening tools have been provided with relatively large foam or rubber blocks that are attached to the housing of the fastening tool.

SUMMARY

In one form, the present teachings provide a fastening tool with a housing assembly, a magazine assembly and one or more deflectable fingers. The housing assembly includes a nosepiece. The magazine assembly, which is coupled to the housing assembly, is configured hold a plurality of fasteners and sequentially feed the fasteners into the nosepiece. The deflectable finger is coupled to the housing assembly and extends outwardly there from.

In another form, the present teachings provide a fastening tool with a housing assembly, a magazine assembly and a plurality of skid-plate assemblies. The housing assembly includes a nosepiece. The magazine assembly, which is coupled to the housing assembly, is configured hold a plurality of fasteners and sequentially feed the fasteners into the nosepiece. Each of the skid plate assemblies includes a plate structure, each of which may be coupled to the housing assembly and/or the magazine assembly, and a bumper structure. Each bumper structure is coupled to an associated plate structure and has a plurality of deflectable fingers that extend outwardly from the associated plate structure.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Additional advantages and features of the present invention will become apparent from the subsequent description and the appended claims, taken in conjunction with the accompanying drawings, wherein:

DETAILED DESCRIPTION OF THE VARIOUS EMBODIMENTS

Figure 1:
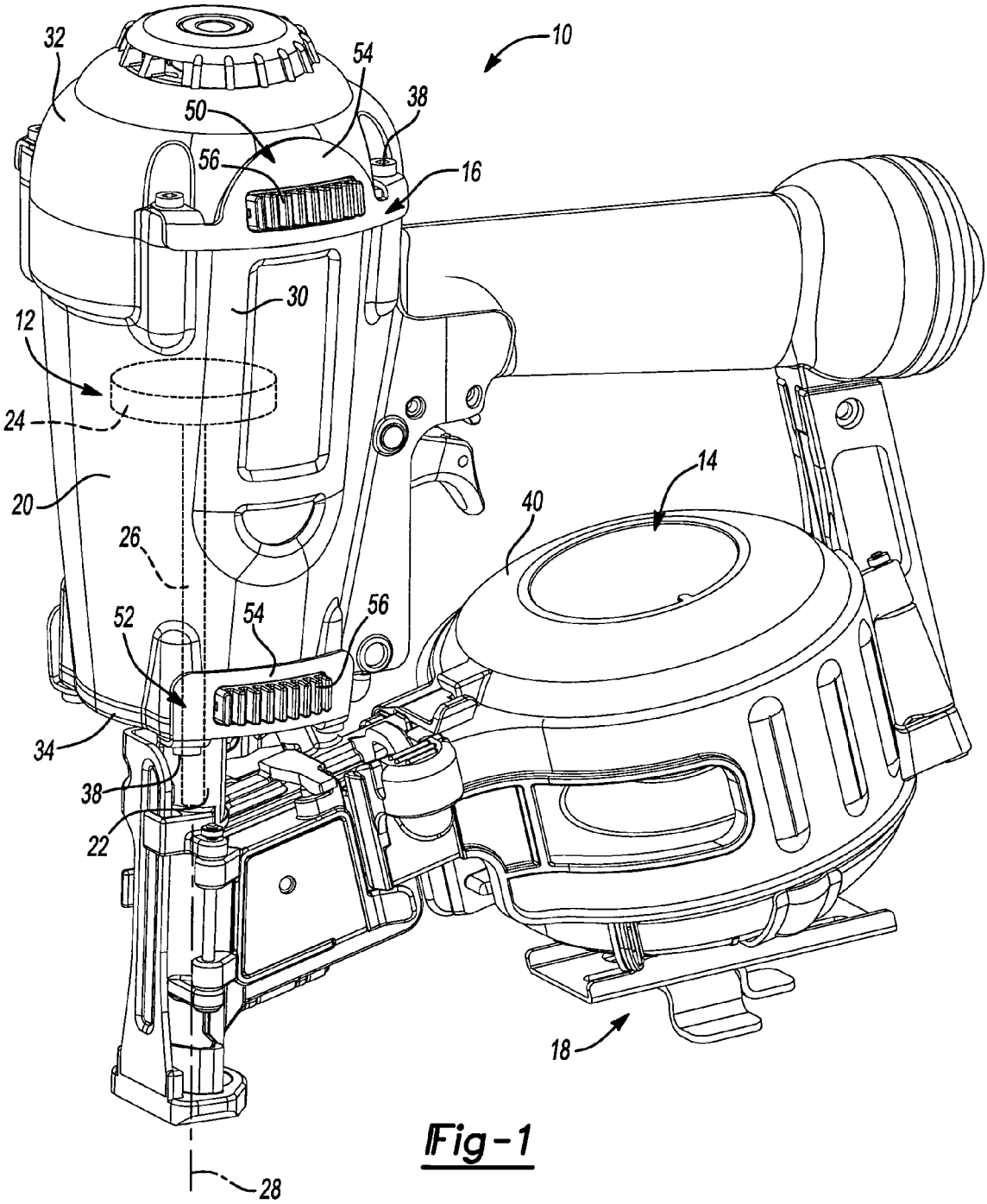
FIG. 1 is a perspective view of a fastening tool constructed in accordance with the teachings of the present invention.
Figure 2:
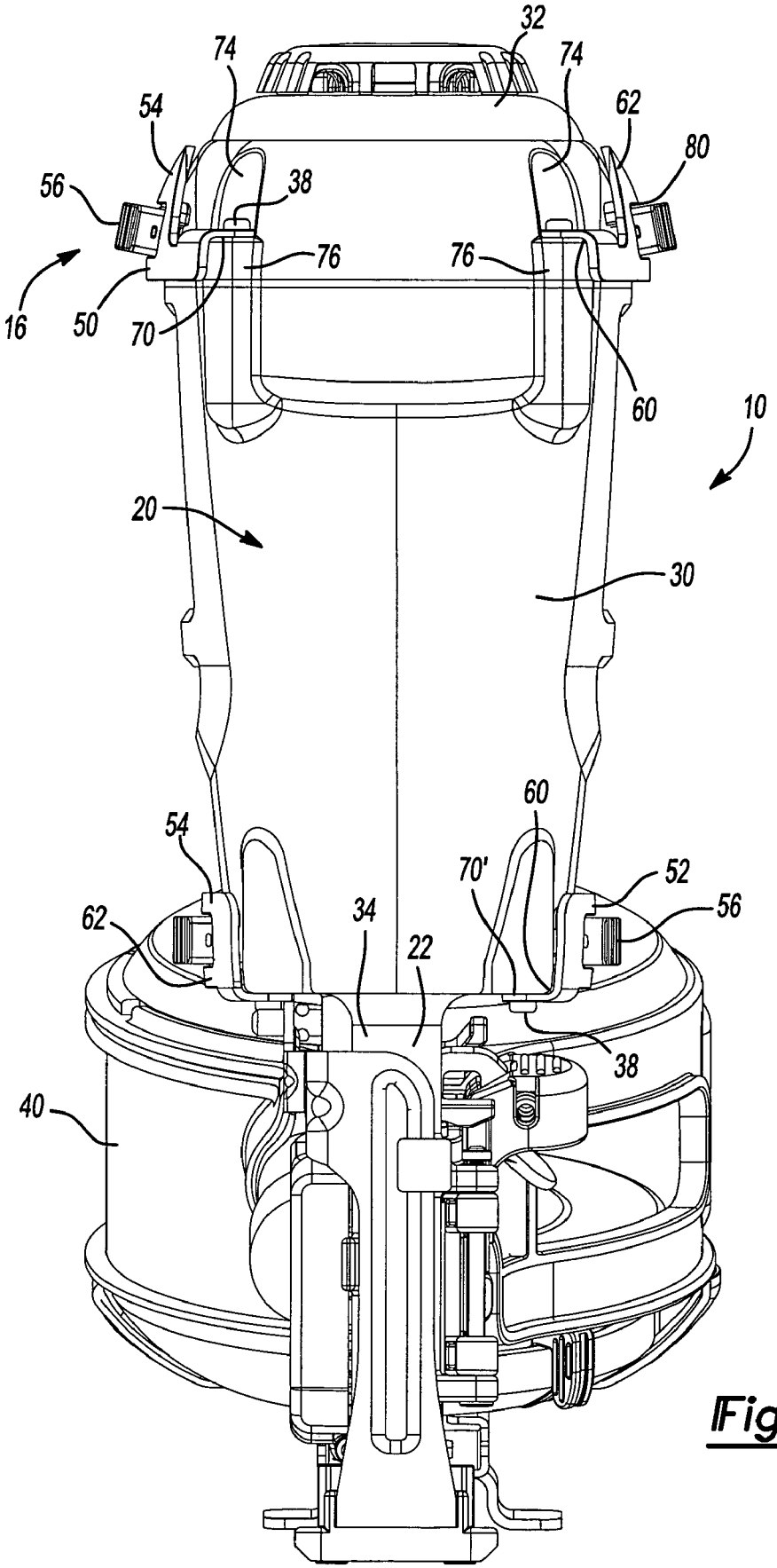
FIG. 2 is a front view of the fastening tool of FIG. 1.

With reference to FIGS. 1 and 2 of the drawings, a fastening tool constructed in accordance with the teachings of the present invention is generally indicated by reference numeral 10. The fastening tool 10 may include a housing assembly 12, a magazine assembly 14, a plurality of skid-plate assemblies 16 and a shingle gauge 18. While the disclosure herein and accompanying illustrations depict the fastening tool 10 as being a nailer of the type that uses a coil of collated nails, those of ordinary skill in the art will appreciate that the teachings of the present invention have applicability to other types of tools, including without limitation staplers, framing nailers and finish nailers.

The housing assembly 12 may include a housing 20, which may be formed from any appropriate material including aluminum, magnesium and/or plastic, and a nosepiece 22. The housing 20 conventionally houses a motor 24 with a driver 26 that may be selectively translated along an axis 28 to drive a fastener into a workpiece (not shown). In the particular example provided, the housing 20 includes a central portion 30 and an upper end cap 32, which is configured to close off an upper end of the central portion 30, while the nosepiece 22 includes an upper flange 34 that is configured to close off a lower end of the central portion 30. Conventional fasteners 38, such as socket head cap screws, may be employed to fixedly but removably couple the upper end cap 32 and nosepiece 22 to the central portion 30. While not specifically shown, those of ordinary skill in the art will appreciate that conventional gaskets or seals may be employed to seal the interfaces between the upper end cap 32 and the central portion 30 and between the central portion 30 and the nosepiece 22.

The magazine assembly 14, which may be coupled to the housing assembly 12, is configured to house a plurality of fasteners and sequentially feed the fasteners into the nosepiece 22. In the particular example provided, the magazine assembly 14 includes a drum 40 for holding coiled, collated nails (not specifically shown).

The skid-plate assemblies 16 may be generally identically formed, or may include two or more discrete and distinct assemblies, such as an upper skid-plate assembly 50 and a lower skid-plate assembly 52 as is illustrated in the example provided. Generally, each skid-plate assembly 16 may include a plate structure 54 and a bumper structure 56. The plate structure 54 may include a mounting portion 60, which may provide a means by which the plate structure 54 may be mounted to the housing assembly 12 and/or the magazine assembly 14, and a body portion 62 that may provide a means by which the bumper structure 56 may be coupled to the plate structure 54. The bumper structure 56 may be common between the upper and lower skid-plate assemblies 50 and 52 as is shown in the example that is provided.

Figure 3:
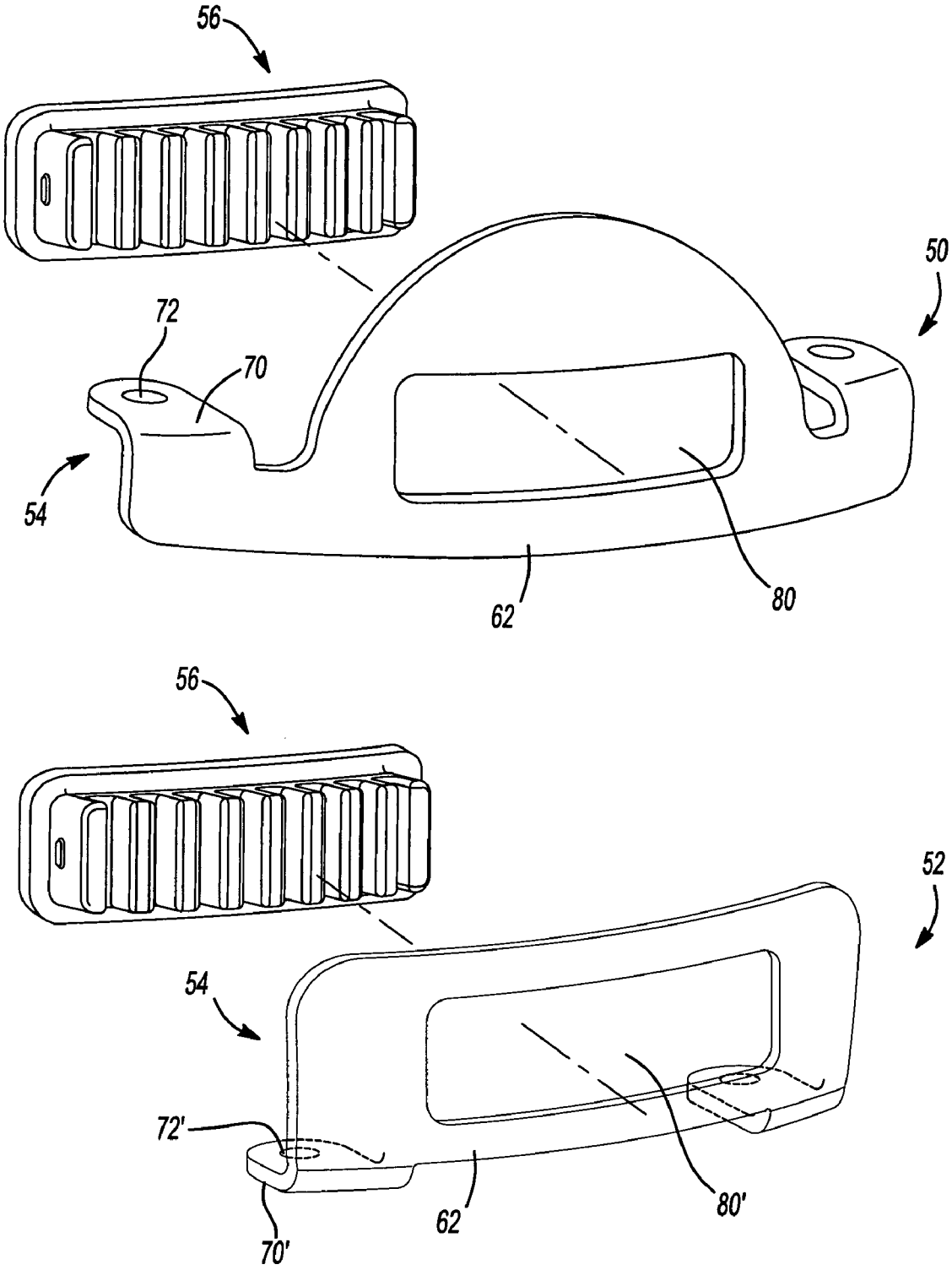
FIG. 3 is an exploded perspective view of a portion of the fastening tool of FIG. 1 illustrating the skid-plate assemblies in greater detail.
Figure 4:
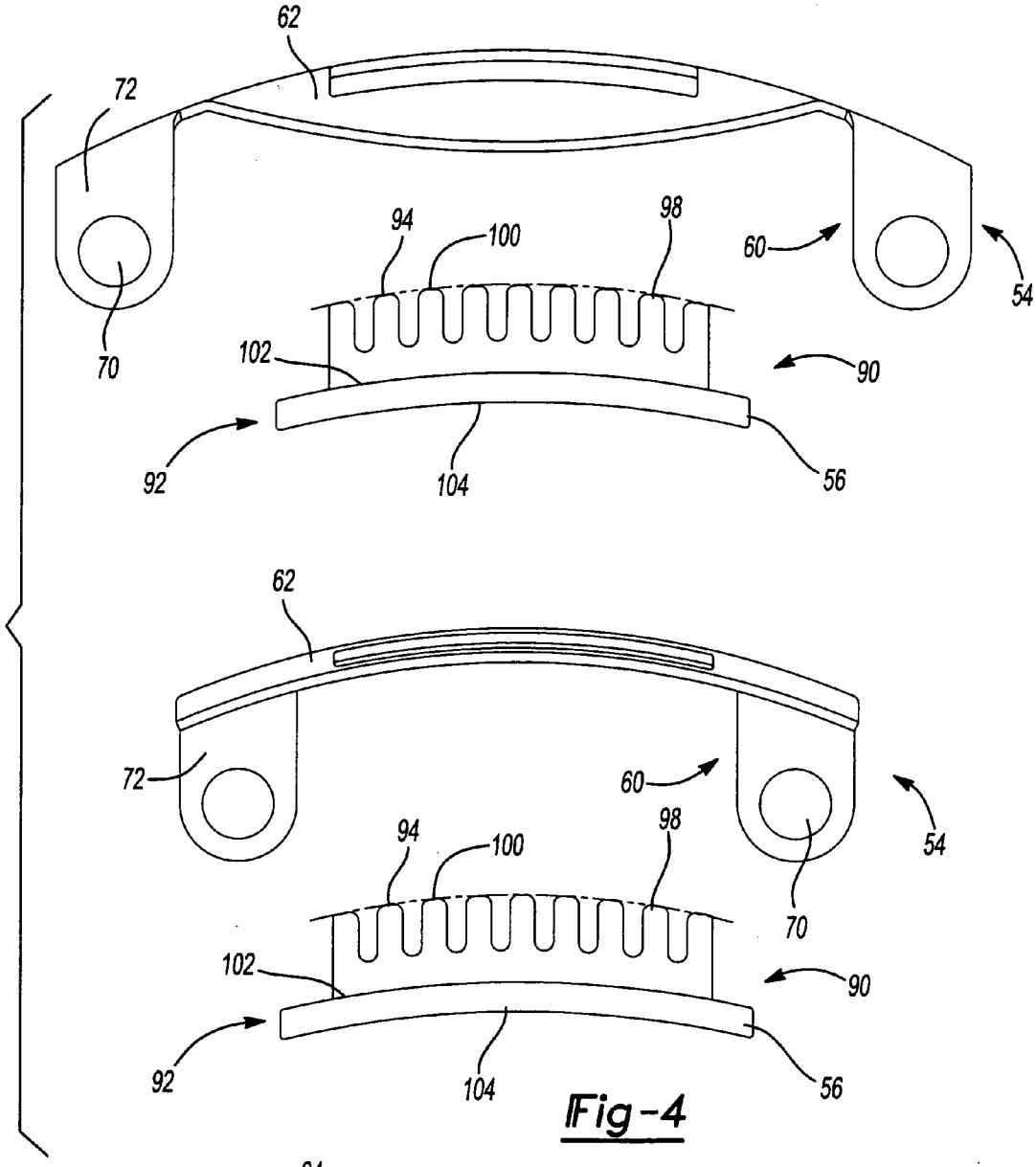
FIGS. 4 and 4A is an exploded elevation view of the skid-plate assemblies of FIG. 3.
Figure 4A:
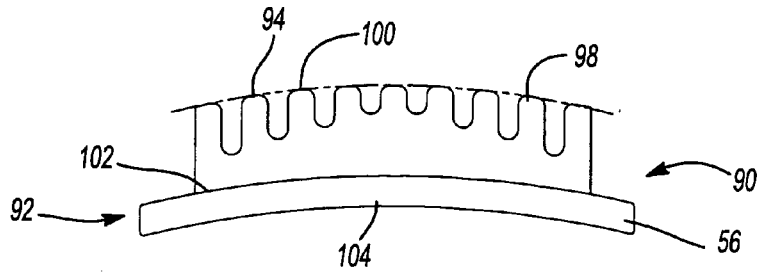

With reference to FIGS. 3, 4 and 4A, the upper and lower skid-plate assemblies 50 and 52 are illustrated in greater detail. As the configuration of the upper and lower skid-plate assemblies 50 and 52 is generally similar, a discussion of the upper skid-plate assembly 50 will suffice for both. Similar or corresponding elements of the lower skid-plate assembly 52 are identified by the same reference numerals as used to describe the upper skid-plate assembly 50 except that the reference numerals are primed.

With reference to FIGS. 2 through 4A, the plate structure 54 of the upper skid-plate assembly 50 may include a mounting portion 60 with a pair of mounting tabs 70. Each of the mounting tabs 70 may be configured to abut the upper end cap 32 and may include an aperture 72 for receiving an associated one of the fasteners 38 therethrough. In the example provided, the mounting tabs 70 fit into a recess 74 and abut a boss 76 that is formed in the upper end cap 32.

The body portion 62 of the plate structure 54 of the upper skid-plate assembly 50 may define an aperture or window 80 that may be employed to mount the bumper structure 56. In the example provided, the window 80 has a closed perimeter. The body portion 62 may have a contour that is approximately matched to that of the portion of the fastening tool 10 over which the body portion 62 is mounted. The body portion 62 may also bend or taper toward the portion of the fastening tool 10 over which the body portion 62 is mounted with increasing distance from the mounting portion 60. Configuration in this manner reduces the distance between the body portion 62 and the housing 20 so as to reduce the likelihood that a foreign object (not shown) will become lodged between the end of the plate structure 54 opposite the mounting portion 60 and the housing 20.

The bumper structure 56 may include a base portion 90 and a flange 92 and may be unitarily formed from a resilient material, such as ELASTOLLAN®, which is commercially available from the BASF Corporation, with a durometer that may be less than or equal to about 60 Shore D, and more preferably about 40 Shore A to about 95 Shore A. The base portion 90 may be configured to fit through the window 80 in the plate structure 54 and may include a plurality of deflectable fingers 94. Each finger 94 may have a height that varies between a first height, such as about 4 mm (0.16 inch) to about 5 mm (0.20 inch), and a second height, such as about 2.9 mm (0.11 inch) to about 3.9 mm (0.15 inch, as shown in FIG. 4A). The fingers 94 may have a relatively uniform thickness, such as about 4.5 mm (0.18 inch) and may be spaced apart from an adjacent finger 94 by a desired distance, such as a distance that is about equal to a thickness of the finger 94. The fingers 94 may have a relatively uniform width, such as about 9 mm (0.35 inch). In the example provided, each finger 94 includes a tip 98 and the tips 98 of the fingers 94 cooperate to define an arcuate contact surface 100. The end of each finger 94 opposite its tip 98 may be defined by a fillet radius 102 to strengthen the location where the fingers 94 intersect the remainder of the bumper structure 56. The fingers are bendable in a direction tangential to the base portion 90.

The flange 92 may be sized somewhat larger than the window 80 to limit the amount by which the fingers 94 extend through the window 80 in the plate structure 54. The flange 92 may include a lower surface 104 that is at least partially defined by a radius that is relatively larger than a radius against which the lower surface 104 may be abutted when the skid-plate assembly 16 is installed to the housing assembly 12 and/or magazine assembly 14. Configuration in this manner ensures that the contact surface 100 will retain a desired shape when the bumper structure 56 is installed to the housing assembly 12 and/or magazine assembly 14.

Each upper skid-plate assembly 50 may be coupled to the housing 20 such that the mounting tabs 70 abut bosses 76 that are formed in the upper end cap 32 and the window 80 (and bumper structure 56) are positioned over the upper end cap 32, while each lower skid-plate assembly 52 may be coupled to the housing 20 such that the mounting tabs 70' abut the upper flange 34 of the nosepiece 22 and the bumper structure 56 is positioned over the lower end of the central housing 30.

Figure 5:
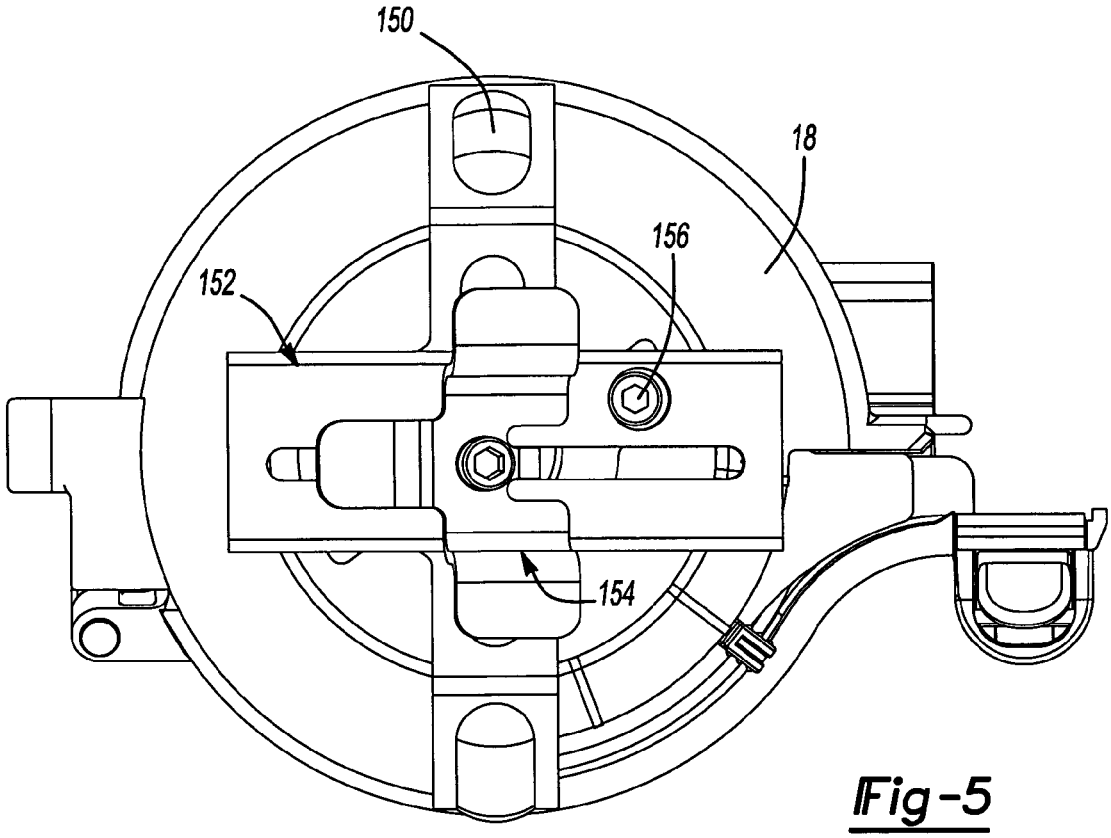
FIG. 5 is a plan view of a portion of the fastening tool of FIG. 1 illustrating the shingle gauge in greater detail.

With reference to FIG. 5, the shingle gauge 18 may include a mounting bracket 150, a shingle scale 152, a shingle edge guide 154 and a fastener, such as a socket head cap screw 156. The mounting bracket 150 may be coupled to the drum 40 of the magazine assembly 14 in a desired manner that permits the shingle scale 152 to be fixedly but removably coupled thereto at a predefined orientation and spacing from the axis 28 (FIG. 1) along which fasteners (not shown) are driven into a workpiece.

Figure 6:
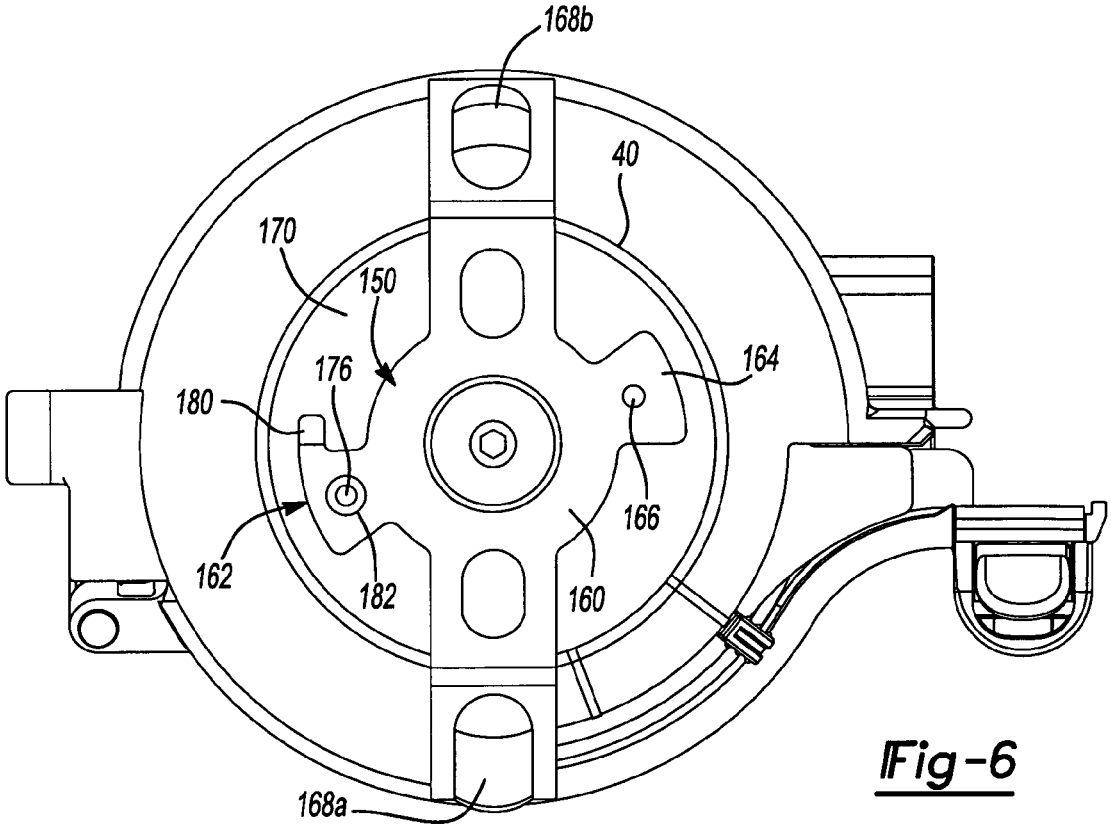
FIG. 6 is a view similar to that of FIG. 5 illustrating the mounting bracket of the shingle gauge in greater detail.
Figure 7:
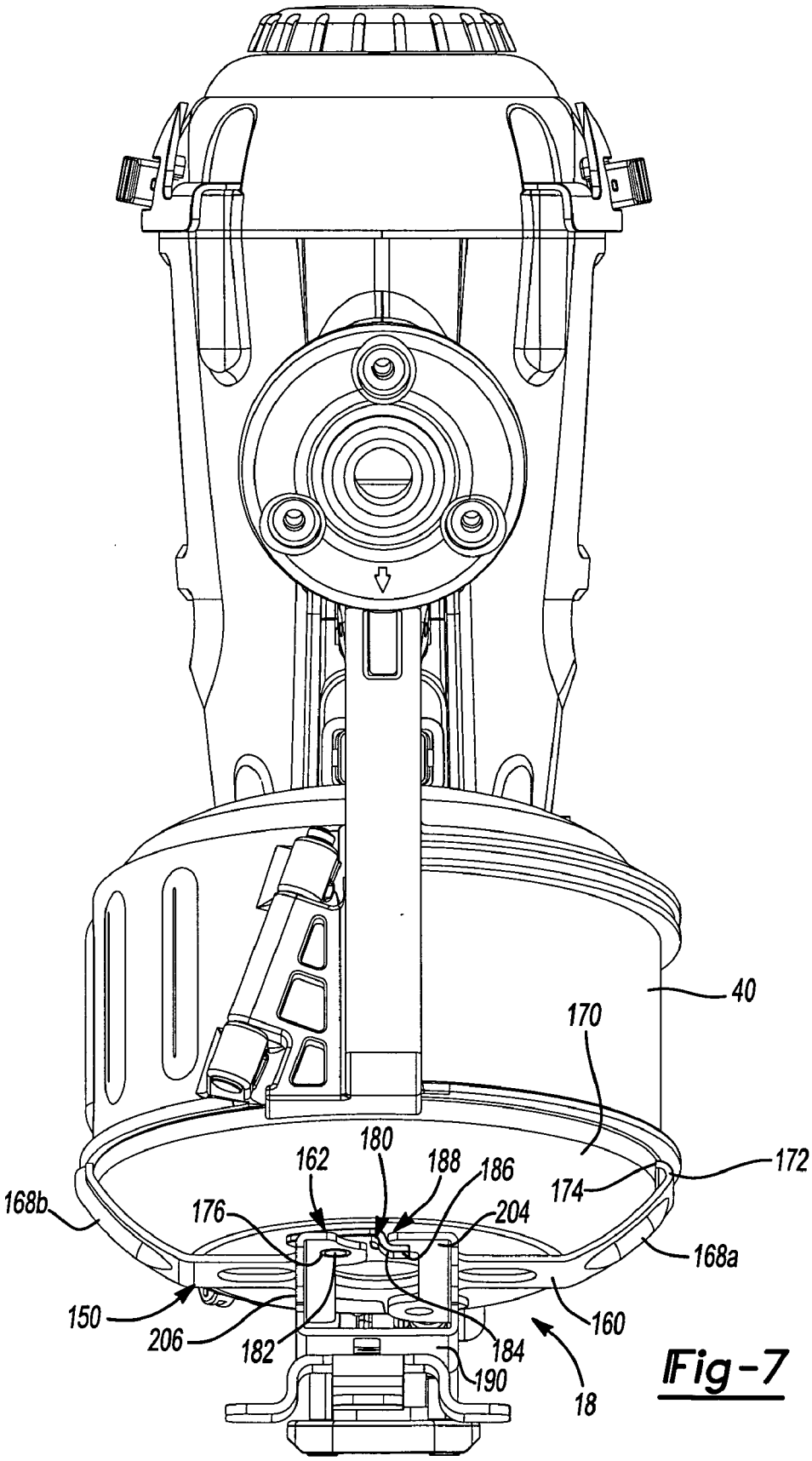
FIG. 7 is a rear elevation view of the fastening tool of FIG. 1.

With reference to FIGS. 6 and 7, the mounting bracket 150 may include a base 160, a first mount 162 and a second mount 164, which may include a threaded aperture 166 that is formed in the base 160. The base 160 may be coupled to the drum 40 in any desired manner and may comprise a pair of arms 168*a* and 168*b* that at least partially wrap about a lower surface 170 of the drum 40. The arm 168*a* may include a hook 172 that is fitted through a slot 174 in the drum 40. A fastener 176 may be employed to secure the mounting bracket 150 to the drum 40 at a second location.

The first mount 162 is coupled to the base 160 and may include a hook 180 and a protrusion 182. The hook 180 may be generally L-shaped, having a base portion 184 that extends generally perpendicular to the base 160 and a leg portion 186 that is coupled to a distal end of the base portion 184 and which extends generally parallel to the base 160. The protrusion 182 is located on a side of the hook 180 opposite the open area 188 of the hook 180. The protrusion 182 may be integrally formed with the base 160, or may be another structure, such as the fastener 176, that extends through the base 160.

Figure 8:
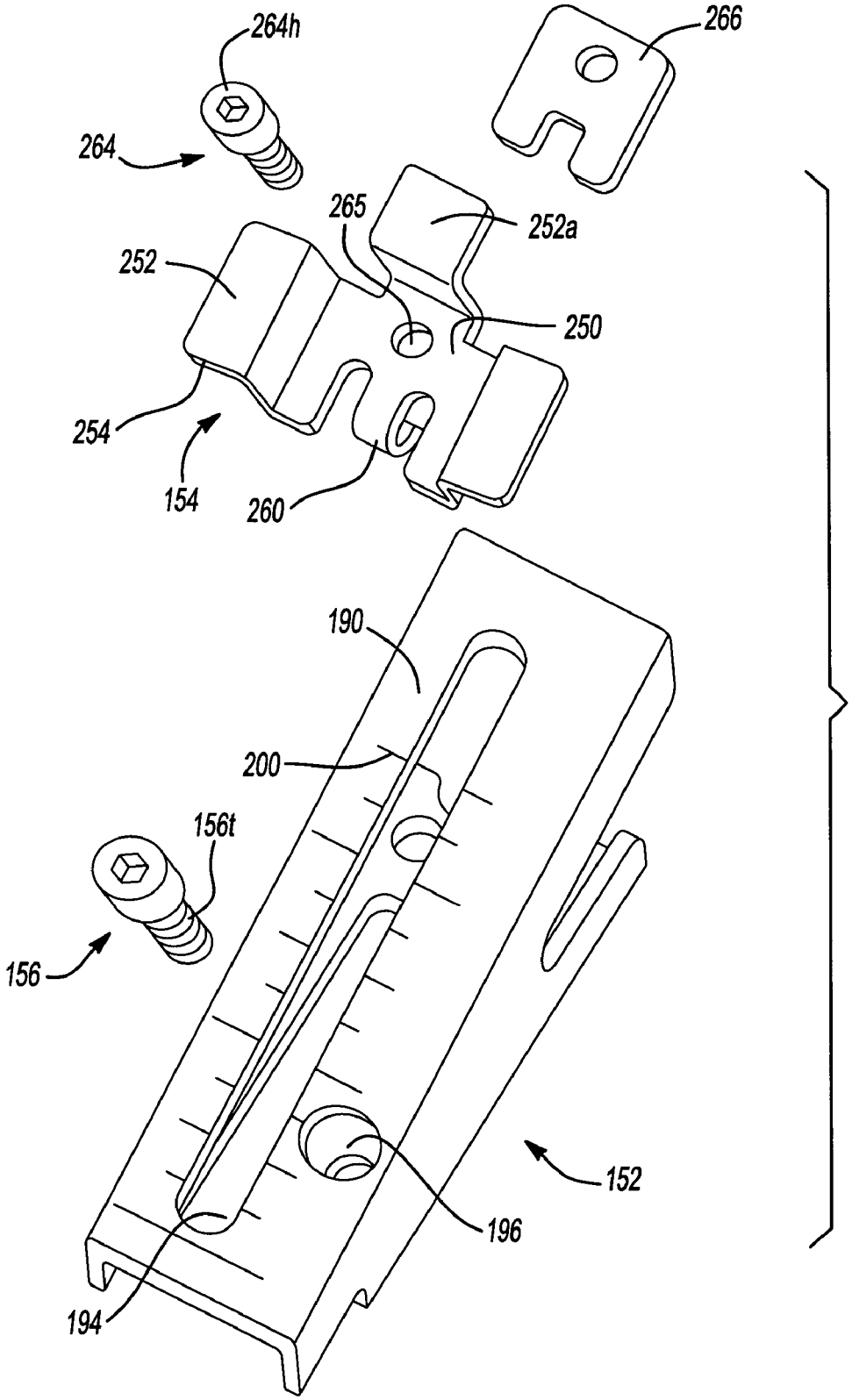
FIG. 8 is an exploded perspective view of a portion of the shingle gauge.
Figure 9:
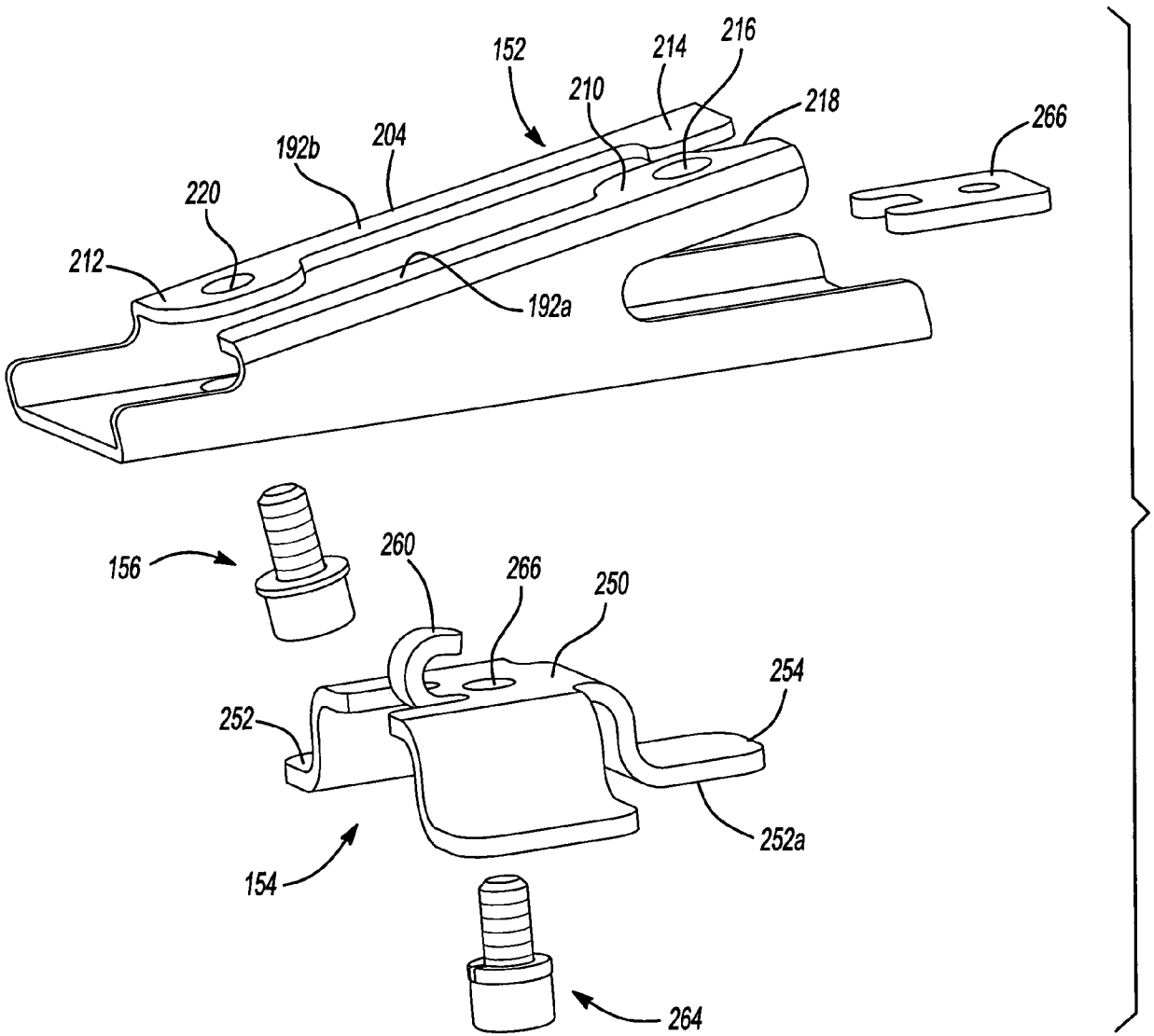
FIG. 9 is an exploded perspective view of a portion of the shingle gauge.
Figure 10:
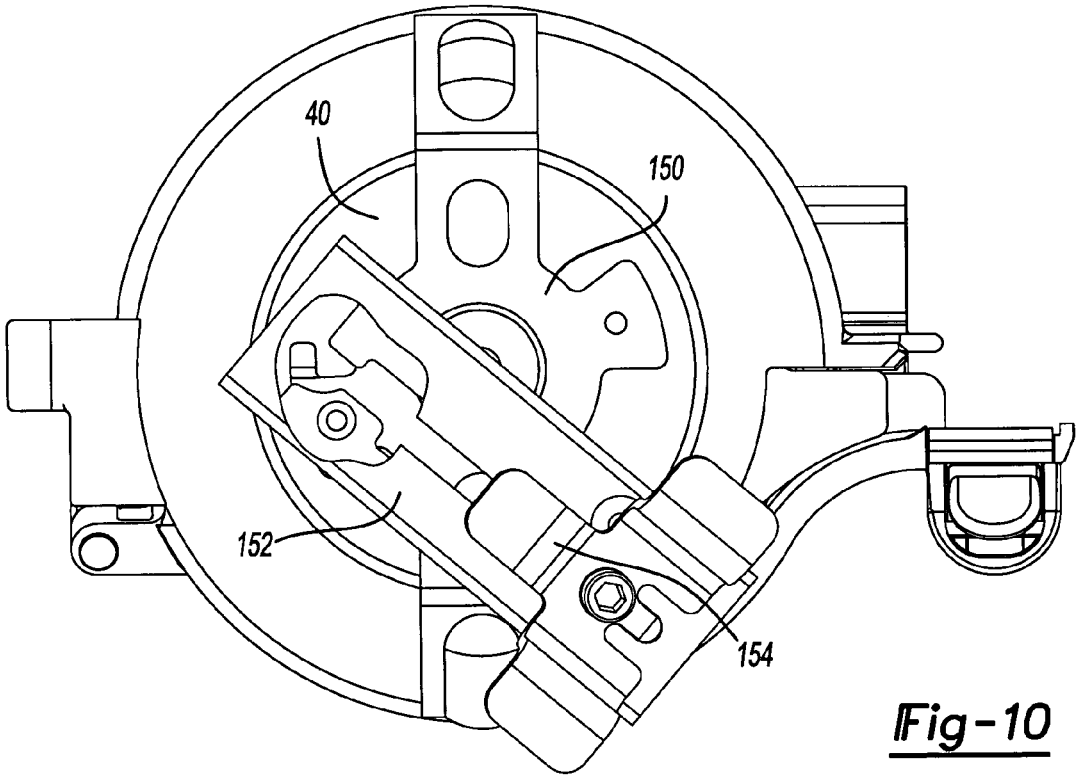
FIG. 10 is a view similar to FIG. 5 but illustrating the shingle scale partially broken away and rotated relative to the mounting bracket to facilitate the installation or removal of the shingle scale.

With reference to FIGS. 8 and 9, the shingle scale 152 may include a scale member 190 and a pair of siderails 192*a* and 192*b* that are disposed on opposite sides of the scale member 190. The scale member 190 may include a slotted aperture 196 and an aperture 198 for receiving the threaded socket head cap screw 156 therethrough. The scale member 190 may be marked, as through engraving, stamping or embossing, with a plurality of scale indicia 200 that are indicative of a distance between a reference datum and the axis 28 (FIG. 1) along which fasteners may be driven into a workpiece or another suitable reference point, such as a flat front surface on the contact trip CT (FIG. 1). The siderails 192*a* and 192*b* may be generally L-shaped with a base portion 204, which may be is configured to abut the mounting bracket 150 (FIGS. 5 & 6), and an arm portion 206 that may be configured to orient the scale member 190 in a predetermined orientation relative to the base portion 204.

The base portion 204 of the siderail 192*a* may include first flange portion 210, while the base portion 204 of the siderail 192*b* may include a second flange portion 212 and a locking tab 214. The first flange portion 210 includes an aperture 216 that is configured to receive and permit the shingle scale 152 to rotate on the protrusion 182. The first flange portion 210 may be notched 218 to permit the shingle scale 152 to rotate about the protrusion 182 through a predetermined angle without the occurrence of contact between the first flange portion 210 and the hook 180. The second flange portion 212 includes an aperture 220 that is aligned with the aperture 196 in the scale member 190 and configured to receive the threaded portion 156*t* of the socket head cap screw 156 therethrough, while the locking tab 214 extends outwardly from the base portion 204 of the siderail 192*b* toward the first flange portion 210 of the siderail 192*a*.

The shingle edge guide 154 may include a structure 250 with one or more feet 252 wherein one of the feet 252*a* defines a reference datum 254. The shingle edge guide 154 may be adjustably coupled to the shingle scale 152 and so as to permit the reference datum 254 to be moved to between a first position, which corresponds to a minimum distance between the reference datum 254 and the reference point, which may be the axis 28 (FIG. 1) or another suitable point, such as the flat front surface on the contact trip CT (FIG. 1), and a second position, which corresponds to a maximum distance between the reference datum 254 and the reference point. In the example provided, the shingle edge guide 154 includes a follower 260, which extends into the slotted aperture 196 in the shingle scale 152, and a clamp 262 with a screw 264 and a clamp plate 266. The screw 264 may be fitted through an aperture 265 in the structure 250 and the slotted aperture 196 in the shingle scale 152 and threadably engage the clamp plate 266 such that the clamp plate 266 and the head 264*h* of the screw 264 engage the opposite sides of the scale member 190 to thereby maintain the reference datum 254 in a desired position. The follower 260 and the screw 264 may be sized relative to a width of the slotted aperture 196 so as to limit an amount by which the shingle edge guide 154 may be rotated relative to the shingle scale 152.

We have found that a significant number of roofers and carpenters prefer not to use a shingle gauge and as such, it is desirable that a shingle gauge or substantial portions thereof be removable from the remainder of the fastening tool. Many of the known shingle gauge devices are relatively cumbersome and difficult for the user to remove, often requiring that various elements of the fastening tool, such as the magazine assembly, be disassembled to the point where tools, such as screwdrivers and wrenches, can be employed to remove or loosen various fasteners that secure the shingle gauge to the remainder of the fastening tool. In contrast to the relatively cumbersome manner in which the prior shingle gauges were coupled to a fastening tool, a substantial portion of the shingle gauge 18 (FIG. 1) that is constructed in accordance with the teachings of the present invention may be installed or removed from the remainder of the fastening tool 10 (FIG. 2) with a single tool and without the need to disassemble other components of the fastening tool 10 (FIG. 2).

Figure 11:
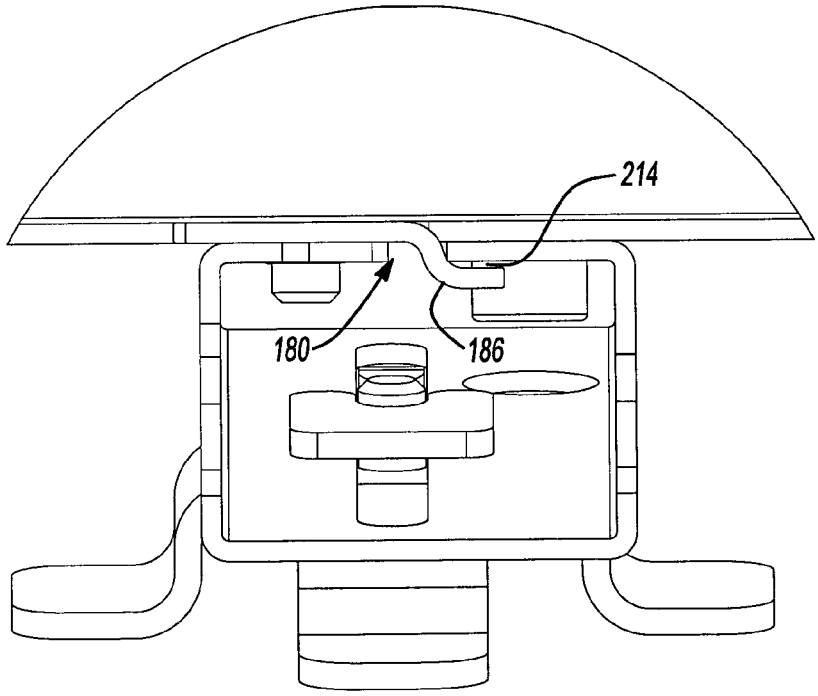
FIG. 11 is an elevation view of a portion of the fastening tool of FIG. 1 illustrating the shingle scale in an aligned condition relative to the mounting bracket.

With reference to FIGS. 6, 9 through 11, the mounting bracket 150 is installed to the drum 40 and the shingle edge guide 154 may be installed to the shingle scale 152. The shingle scale 152 is positioned relative to the mounting bracket 150 such that the aperture 216 is aligned to the protrusion 182. The shingle scale 152 may be rotated relative to the mounting bracket 150 to permit the shingle edge guide 154 to be fitted over the protrusion 182. In this regard, the notched portion 218 of the first flange portion 210 may be aligned to the hook 180, while the locking tab 214 may be rotated away from the hook 180 so that neither of the first flange portion 210 or the locking tab 214 contact the hook 180 as the shingle scale 152 is lowered onto the protrusion 182. When fitted onto the protrusion 182 and abutted against the base 160 of the mounting bracket 150, the shingle scale 152 may be rotated about the protrusion 182 (i.e., counter-clockwise in the example provided) as is shown in FIGS. 5 and 11 such that the locking tab 214 is located beneath the leg portion 186 of the hook 180 and the aperture 220 (FIG. 9) in the second flange portion 212 (FIG. 9) is aligned to the threaded aperture 166 (FIG. 6) in the second mount 164 (FIG. 6) in the base 160.

With reference to FIGS. 5, 6, 8 and 9, the cap screw 156 may be inserted through the aperture 196 in the scale member 190, into the aperture 220 in the second flange portion 212 and threadably engaged to the threaded aperture 166 in the second mount 164. Tightening of the cap screw 156 fixedly but removably couples the shingle scale 152 to the base 160 at a first location, while the hook 180 and protrusion 182 cooperate with the locking tab 214 and aperture 216 cooperate to secure the shingle scale 152 to the base 160 at a second location.

Those of ordinary skill in the art will appreciate from this disclosure that the shingle scale 152 may be removed from the base 160 by reversing the above steps (i.e., removing the cap screw 156, rotating the shingle scale 152 about the protrusion 182 to a position where the shingle scale 152 may be lifted off the base 160, and lifting the shingle scale 152 off the mounting bracket 150).

Figure 12:
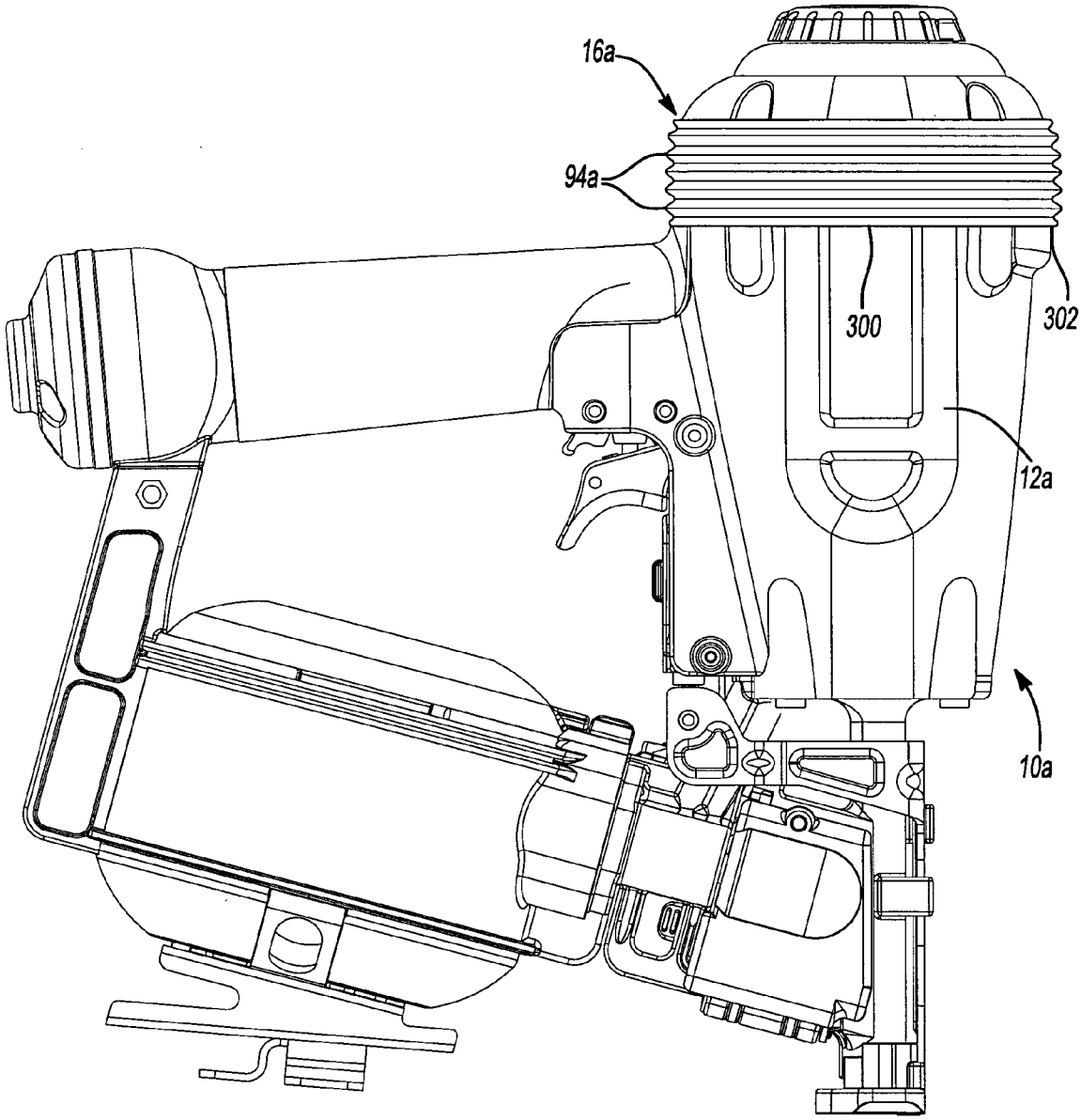
FIG. 12 is a right elevation view of another fastening tool constructed in accordance with the teachings of the present invention.
Figure 13:
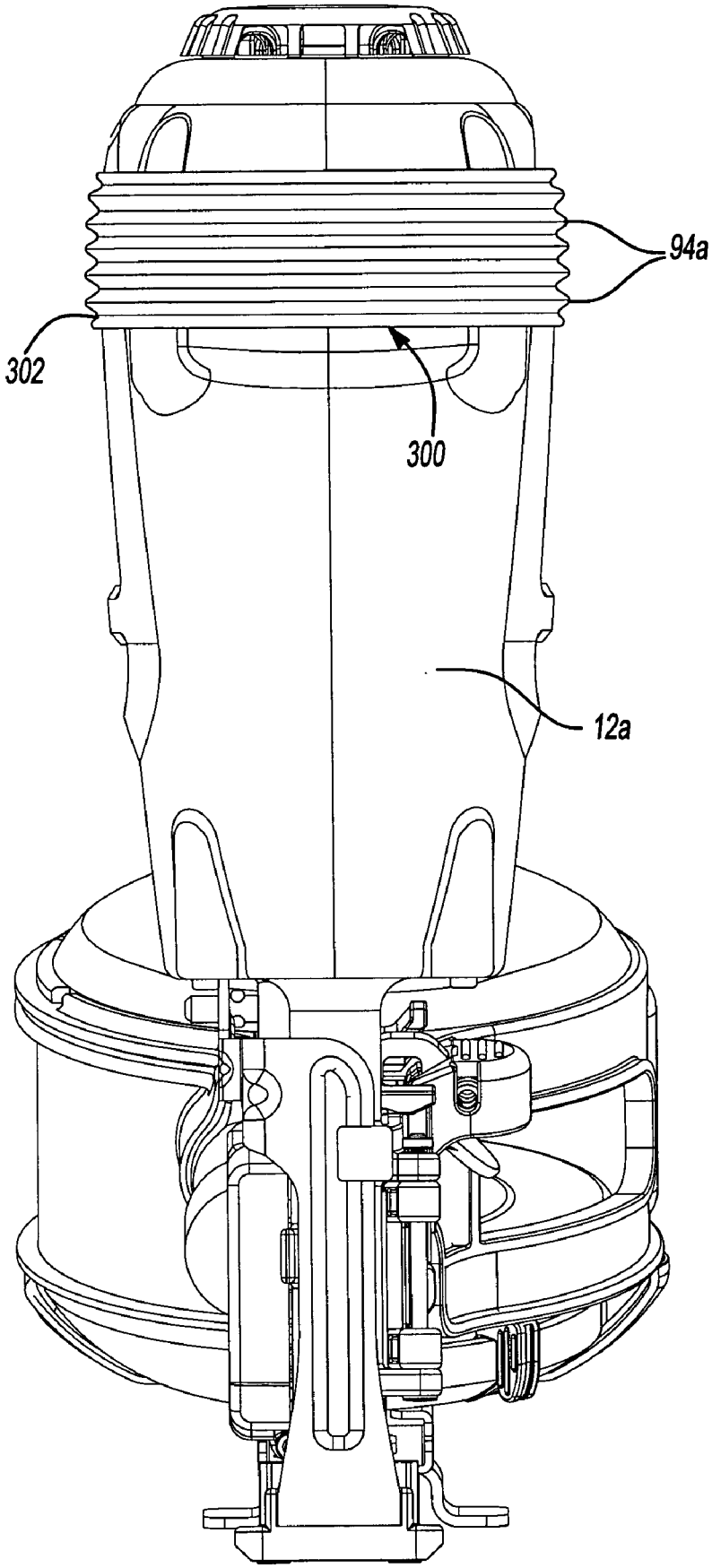
FIG. 13 is a front view of the fastening tool of FIG. 12.

While the fastening tool 10 has been discussed thus far as including a plurality of skid-plate assemblies 16 and a shingle gauge 18 with a shingle edge guide 154 that employ a tool, such as an Allen wrench, to facilitate its adjustment, those of ordinary skill in the art will appreciate from this disclosure that the present invention, in its broader aspects, may be constructed somewhat differently. For example, the skid-plate assemblies 16*a* may be constructed as illustrated FIGS. 12 and 13. The skid-plate assemblies 16*a* may comprise one or more resilient bands 300 that may be stretched over and fitted about an associated portion of the fastening tool 10*a*, such as the housing assembly 12*a*. In the example provided, the band 300 includes a body portion 302, which is disposed adjacent the housing assembly 12*a*, and a plurality of deflectable fingers 94*a* that extend outwardly from the body portion 302 away from the housing assembly 12*a*.

Figure 14:
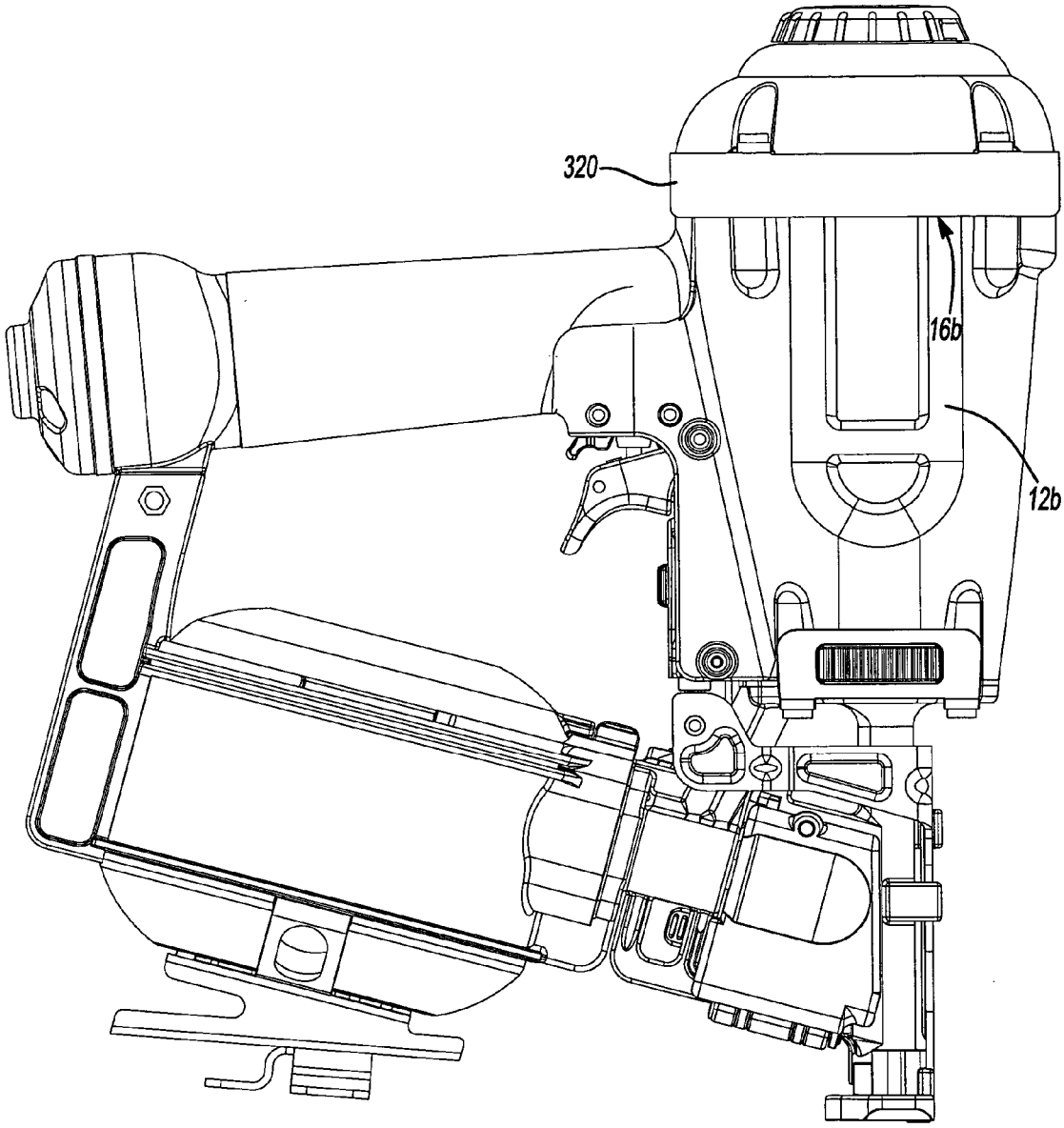
FIG. 14 is a right elevation view of another fastening tool constructed in accordance with the teachings of the present invention.
Figure 15:
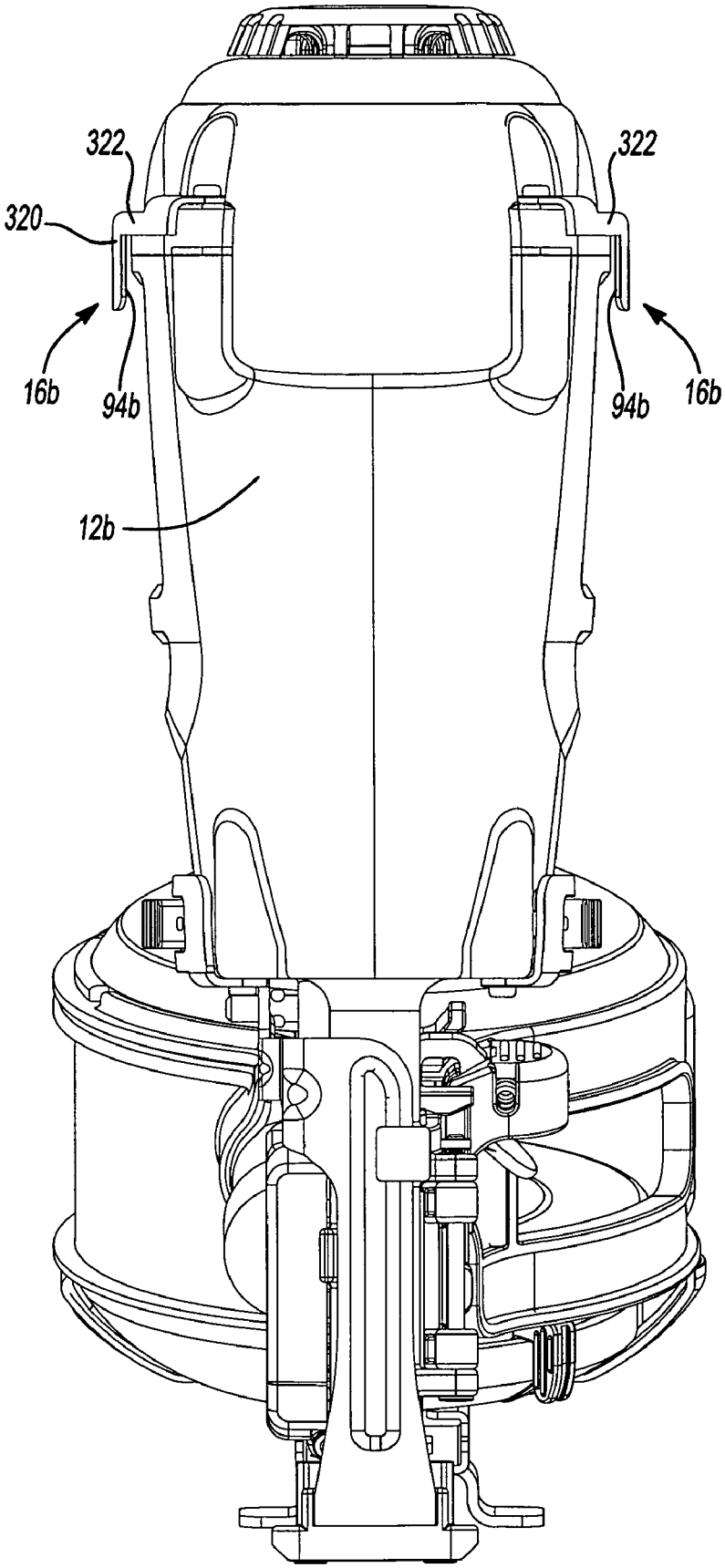
FIG. 15 is a front view of the fastening tool of FIG. 14.

In the example of FIGS. 14 and 15, the skid-plate assemblies 16*b* may comprise an L-shaped member 320 that may be fixedly coupled to selected portions of the fastening tool 10*b*, such as the housing assembly 12*b*. The L-shaped member 320 may include a first portion 322, which extends outwardly from the housing assembly 12*b*, and a second portion or finger 94*b*, which is spaced apart from the housing assembly 12*b* and generally parallel thereto. The L-shaped member 320 may be formed of a relatively rigid material, such as sheet steel, or a more flexible material that permits one or more portions of the L-shaped member 320, such as the finger 94*b*, to more readily deflect. Where the L-shaped member 320 is formed of a relatively rigid material, the skid-plate assemblies 16*b* may be additionally or alternatively configured to be clipped onto an object, such as the edge of a shingle (not shown).

Figure 16:
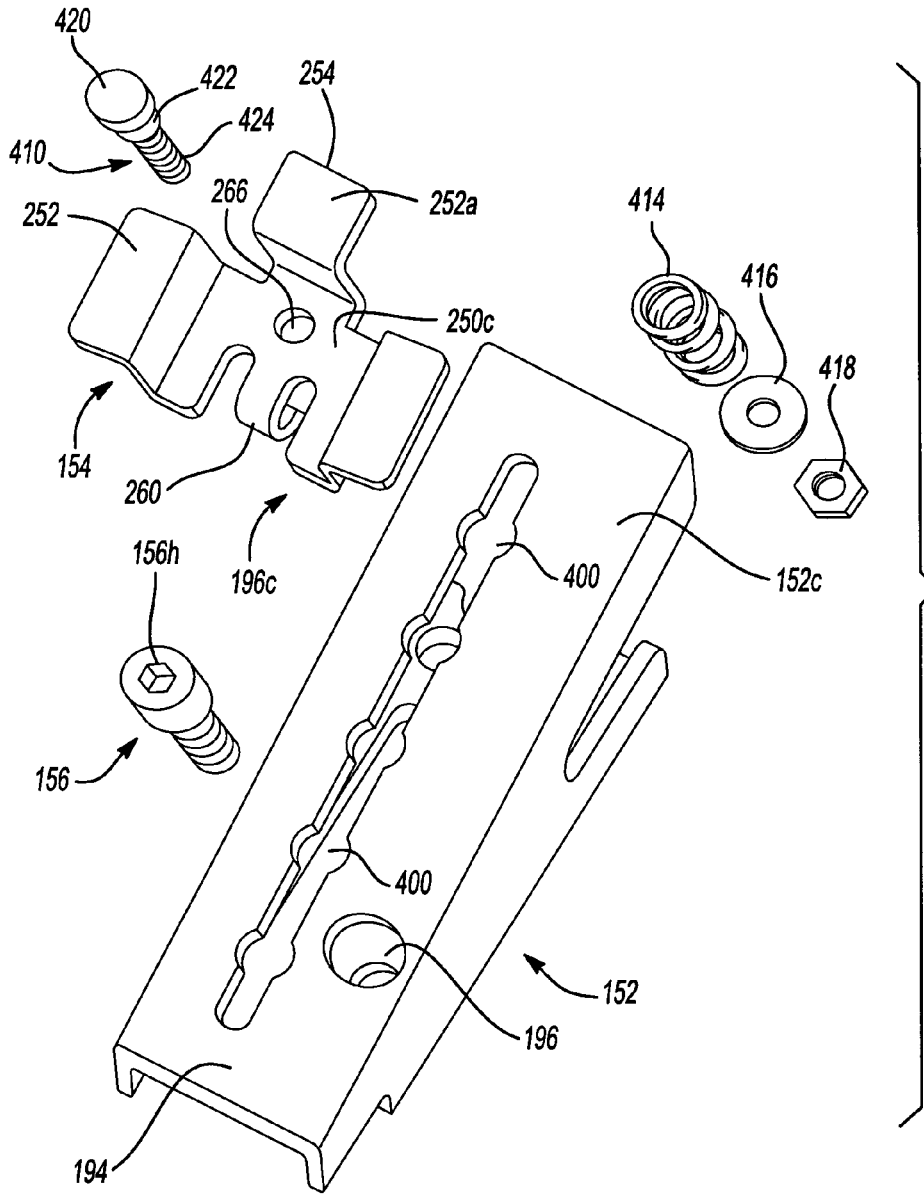
FIG. 16 is an exploded perspective view similar to FIG. 8 but illustrating an alternately constructed shingle gauge.
Figure 17:
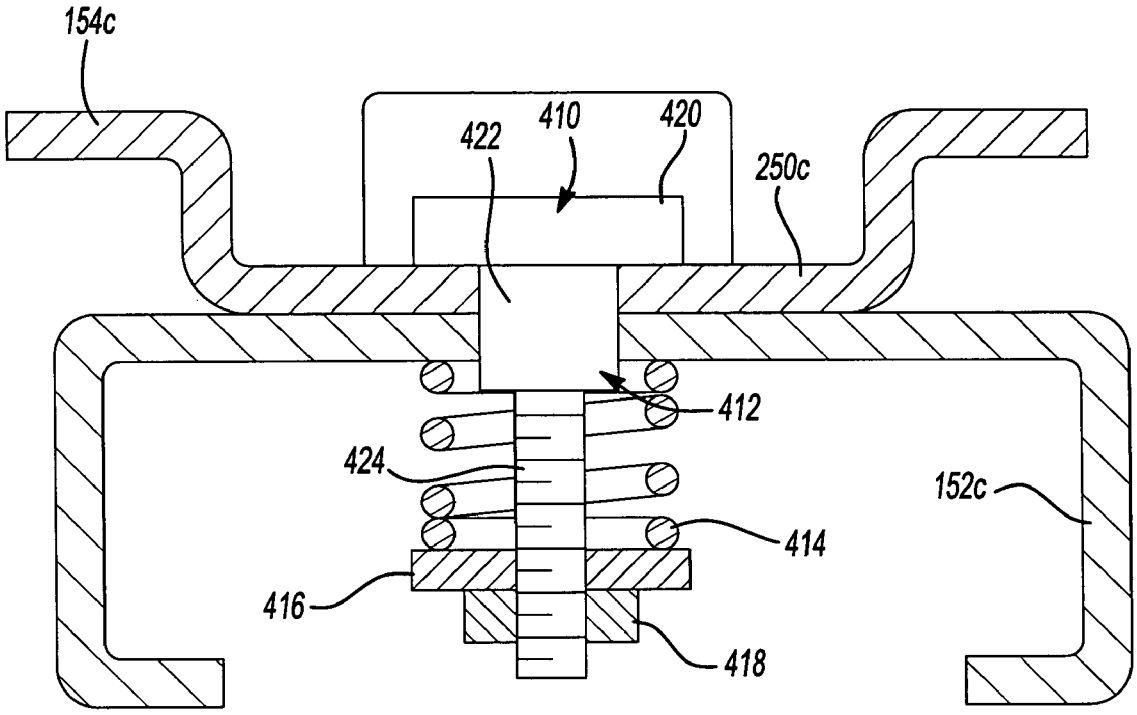
FIG. 17 is a sectional view of a portion of the shingle gauge shown in FIG. 16.

With reference to FIGS. 16 and 17, the shingle scale 152*c* and the shingle edge guide 154*c* may be configured to permit a user to adjust the position of the reference datum (not specifically shown) between a plurality of predetermined position without the use of tools. The shingle scale 152*c* is generally similar to the shingle scale 152 of FIG. 8, except that the slotted aperture 196*c* intersects a plurality of spaced apart locating recesses 400. The shingle edge guide 154*c* may include a structure 250*c* and a fastener 410. The structure 250*c* may be generally similar to the structure 250 of FIG. 8 except as noted below, while the fastener 410 may include a pin 412, a spring 414, a washer 416 and a nut 418. The pin 412 may include a head portion 420, a first body portion 422 and a second body portion 424. The first body portion 422 has a size that is intermediate the head portion 420 and the second body portion 424 and is configured to slip fit into the locating recesses 400. The head portion 420 may be fixedly coupled to the structure 250*c*, as through welding, and is relatively larger than the first body portion 422. The first body portion 422 is relatively larger than the slotted aperture 196*c* and as such, will not fit through the slotted aperture 196*c*. With the pin 412 extending through structure 250*c* of the shingle edge guide 154*c* and the scale member 190*c* of the shingle scale 152*c*, the washer 416 and nut 418 may be employed to secure the spring 414 to the pin 412 to permit the spring 414 to bias the head portion 420 against the structure 250*c*.

The user may position the shingle edge guide 154*c* relative to the shingle scale 152*c* by pulling the shingle edge guide 154*c* away from the shingle scale 152*c* to thereby position the second body portion 424 of the pin 412 within the locating recess 400 in the shingle scale 152*c*. As the second body portion 424 of the pin 412 is smaller than the slotted aperture 196*c*, the user may pull or push the shingle edge guide 154*c* to position the second body portion 424 of the pin 412 into a desired one of the locating recesses 400. Thereafter, the user may release the shingle edge guide 154*c* to permit the spring to draw the first body portion 422 of the pin 412 into the desired one of the locating recesses 400 and clamp the shingle edge guide 154*c* to the shingle scale 152*c*. As the first body portion 422 is sized relatively larger than the slotted aperture 196*c*, unintended sliding movement of the shingle edge guide 154*c* relative to the shingle scale 152*c* is inhibited. Those of ordinary skill in the art will appreciate from this disclosure that unintended rotational movement of the shingle edge guide 154*c* relative to the shingle scale 152*c* may be inhibited through the use of a follower, which is similar to the follower 260 described above and illustrated in FIG. 8. Those of ordinary skill in the art will also appreciate from this disclosure that other detent mechanisms may be substituted for that which is shown in the figures and discussed above.

While the invention has been described in the specification and illustrated in the drawings with reference to various embodiments, it will be understood by those skilled in the art that various changes may be made and equivalents may be substituted for elements thereof without departing from the scope of the invention as defined in the claims. Furthermore, the mixing and matching of features, elements and/or functions between various embodiments is expressly contemplated herein so that one of ordinary skill in the art would appreciate from this disclosure that features, elements and/or functions of one embodiment may be incorporated into another embodiment as appropriate, unless described otherwise, above. Moreover, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the foregoing description and the appended claims.

What is claimed is:

1. A fastening tool comprising:

a housing assembly with a nosepiece;

a magazine assembly coupled to the housing assembly and adapted to hold a plurality of fasteners and sequentially feed the fasteners into the nosepiece; and a bumper structure coupled to the housing assembly, the bumper structure having a body portion and a deflectable finger set extending outwardly therefrom, fingers of the deflectable finger set being bendable in a direction tangential to the body portion.

2. The fastening tool of claim 1, further comprising a plate structure, the plate structure including a mount portion, which is mounted to the housing assembly, and a body portion to which the deflectable finger set is coupled.

3. The fastening tool of claim 1, wherein fingers of the deflectable finger set have a height that varies between a first height and a second height.

4. The fastening tool of claim 1, wherein fingers of the deflectable finger set are generally parallel to one another.

5. The fastening tool of claim 4, wherein the deflectable finger set is disposed generally parallel to an axis along which the fasteners are dispensed from the nosepiece.

* * * * *